United States Patent [19]

Polanco et al.

[11] Patent Number: 4,801,304

[45] Date of Patent: Jan. 31, 1989

[54] PROCESS FOR THE PRODUCTION AND BURNING OF A NATURAL-EMULSIFIED LIQUID FUEL

[75] Inventors: Domingo R. Polanco, Los Teques; Ignacio Layrisse, Edif. San Luis; Hercilio Rivas; G. Euler Jimenez, both of Caracas; Lirio Q. de Paz, Los Teques; Jose P. Salazar, San Antonio de Los Altos; Mayela Rivero, Edo. Mirando; Emilio Guevara; Maria L. Chirinos, both of Caracas, all of Venezuela

[73] Assignee: Intevep, S.A., Caracas, Venezuela

[21] Appl. No.: 875,450

[22] Filed: Jun. 17, 1986

[51] Int. Cl.[4] ..... C10L 1/32

[52] U.S. Cl. ..... 44/51; 166/371; 137/13; 252/312; 431/3; 431/4; 431/8; 431/12

[58] Field of Search ..... 431/3, 4, 8, 12; 44/51; 137/13; 166/371; 252/312

[56] References Cited

U.S. PATENT DOCUMENTS

| | | | |
|---|---|---|---|
| 2,845,338 | 7/1958 | Ryznar et al. | 44/5 |
| 3,332,755 | 7/1967 | Kukin | 44/4 |
| 3,380,531 | 4/1968 | McAuliffe et al. | 166/371 |
| 3,467,195 | 9/1969 | McAuliffe et al. | 166/371 |
| 3,519,006 | 7/1970 | Simon et al. | 137/13 |
| 3,837,820 | 9/1974 | Kukin | 44/5 |
| 3,876,391 | 4/1975 | McCoy et al. | 44/51 |
| 3,902,869 | 9/1975 | Friberg et al. | 44/51 |
| 3,943,954 | 3/1976 | Flournoy et al. | 137/13 |
| 4,002,435 | 1/1977 | Wenzel et al. | 44/51 |
| 4,046,519 | 9/1977 | Piotrowski | 44/51 |
| 4,084,940 | 4/1978 | Lissant | 44/51 |
| 4,099,537 | 7/1978 | Kalfoglou et al. | 137/13 |
| 4,108,193 | 8/1978 | Flournoy et al. | 137/13 |
| 4,144,015 | 3/1979 | Berthiaume | 431/8 |
| 4,158,551 | 6/1979 | Feuerman | 44/51 |
| 4,162,143 | 7/1979 | Yount III | 44/51 |
| 4,239,052 | 12/1980 | McClaflin | 137/13 |
| 4,315,755 | 2/1982 | Hellsten et al. | 44/51 |
| 4,379,490 | 4/1983 | Sharp | 166/371 |
| 4,382,802 | 5/1983 | Beinke et al. | 44/51 |
| 4,392,865 | 7/1983 | Grosse et al. | 44/51 |
| 4,416,610 | 11/1983 | Gallagher, Jr. | 431/4 |
| 4,445,908 | 5/1984 | Compere et al. | 44/51 |
| 4,477,258 | 10/1984 | Lepain | 44/51 |
| 4,488,866 | 12/1984 | Schirmer | 431/4 |
| 4,512,774 | 4/1985 | Meyers | 44/51 |
| 4,570,656 | 2/1986 | Matlach et al. | 137/13 |
| 4,618,348 | 10/1986 | Hoyes et al. | 431/4 |
| 4,627,458 | 12/1986 | Prasad | 137/13 |

FOREIGN PATENT DOCUMENTS

| | | |
|---|---|---|
| 55-63035 | 12/1981 | Japan . |
| 974042 | 11/1964 | United Kingdom . |

*Primary Examiner*—William R. Dixon, Jr.
*Assistant Examiner*—Margaret B. Medley
*Attorney, Agent, or Firm*—Bachman & LaPointe

[57] ABSTRACT

A process for the preparation of a natural liquid fuel and, more particularly, a process that allows a high sulfur natural fuel to be converted into energy by combustion with a substantial reduction in sulfur oxide emissions.

10 Claims, 4 Drawing Sheets

SCHEME FOR PRODUCTION, HANDLING CONDITIONING AND COMBUSTION OF EMULSIFIED NAT. FUEL

SCHEME FOR PRODUCTION, HANDLING CONDITIONING AND COMBUSTION OF EMULSIFIED NAT. FUEL

PROCESS FOR THE PRODUCTION AND BURNING OF A NATURAL-EMULSIFIED LIQUID FUEL

BACKGROUND OF THE INVENTION

The present invention relates to a process for the preparation of a natural liquid fuel and, more particularly, a process that allows a high sulfur natural fuel to be converted into energy by combustion with a substantial reduction in sulfur oxide emissions.

Natural bitumens found in Canada, The Soviet Union, United States, China and Venezuela are normally liquid with viscosities ranging from 10,000 to 200,000 CP and API gravities of less than 10. These natural bitumens are currently produced either by mechanical pumping, steam injection or by mining techniques. Wide spread use of these materials as fuels is precluded for a number of reasons which include difficulty in production, transportation and handling of the material and, more importantly, unfavorable combustion characteristics including high sulfur oxide emissions and unburned solids. Because of the foregoing, the natural bitumens have not been successfully used on a commercial basis as fuels due to the high costs associated with steam injection, pumping and flue gas desulfurization systems which are necessary in order to overcome the foregoing difficulties.

Naturally it would be highly desirable to be able to use the natural bitumens of the type set forth above as a natural fuel.

Accordingly, it is a principal object of the present invention to provide a process for the production of a natural liquid fuel from natural bitumens.

It is a particular object of the present invention to produce a natural liquid fuel from natural bitumens by forming an oil in water emulsion of said natural bitumens.

It is a further object of the present invention to provide an oil in water emulsion for use as a liquid fuel having characteristics for optimizing the combustion project.

It is a still further object of the present invention to provide optimum burning conditions for the combustion of an oil in water emulsion of natural bitumens so as to obtain excellent combustion efficiency, low unburned particulate solids and low sulfur oxide emissions.

Further objects and advantages of the present invention will appear hereinbelow.

SUMMARY OF THE INVENTION

The present invention relates to a process for the preparation of a natural liquid fuel and, more particularly, a process that allows a high sulfur natural fuel to be converted into energy by combustion with a substantial reduction in sulfur oxide emissions.

In accordance with the present invention a mixture of water plus an emulsifying agent is injected into a well so as to form a downhole oil in water emulsion. U.S. Pat. No. 3,467,195 to McAuliffe et al. discloses a suitable process for forming a downhole oil in water emulsion suitable for use in the process of the present invention and is incorporated herein by reference. The amount of water in the emulsifying agent injected into the well is controlled so as to form an oil in water emulsion having specific characteristics with regard to water content, droplet size and alkali metal content. In accordance with a particular feature of the present invention it has been found that in order to optimize combustion characteristics of the oil in water emulsion, the oil in water emulsion formed downhole should be characterized by a water content of 15 to 35 wt. %, a droplet size of about 10 to 60 μm and an alkali metal content of about 50 to 600 ppm. The emulsifying agent is preferably present in the oil in water emulsion in an amount of between 0.1 to 5% by weight based on the total weight of oil in water emulsion.

The downhole oil in water emulsion is then pumped by a downhole deep well pump as is known in the art to a flow station where degasification can be accomplished if necessary. The oil in water emulsion is thereafter transported to a combustion station. At the combustion station the oil in water emulsion is conditioned so as to optimize the water content, droplet size and alkali metal content for burning. After conditioning the oil in water emulsion is characterized by a water content of 15 to 35 wt. %, a droplet size of about 10 to 60 μm and an alkali metal content of about 50 to 600 ppm. The emulsion is then burned under the following conditions: fuel temperature (°C.) of 20 to 80, preferably 20 to 60, stream/fuel ratio (wt/wt) of 0.05, preferably 0.05 to 0.4, air/fuel ration (wt/wt) of 0.05 to 0.4, preferably 0.5 to 0.3, and steam pressure (Bar) of 2 to 6, preferably 2 to 4, or air pressure (Bar) of 2 to 7, preferably 2 to 4.

In accordance with the present invention it has been found that the oil in water emulsion produced in the process of the present invention, when conditioned in accordance with the present invention and burned under controlled operating conditions, results in a combustion efficiency of 99.9%, a low particulate solids content and sulfur oxide emissions consistent with that obtained when burning traditional No. 6 fuel oil.

DETAILED DESCRIPTION

Figure 1:
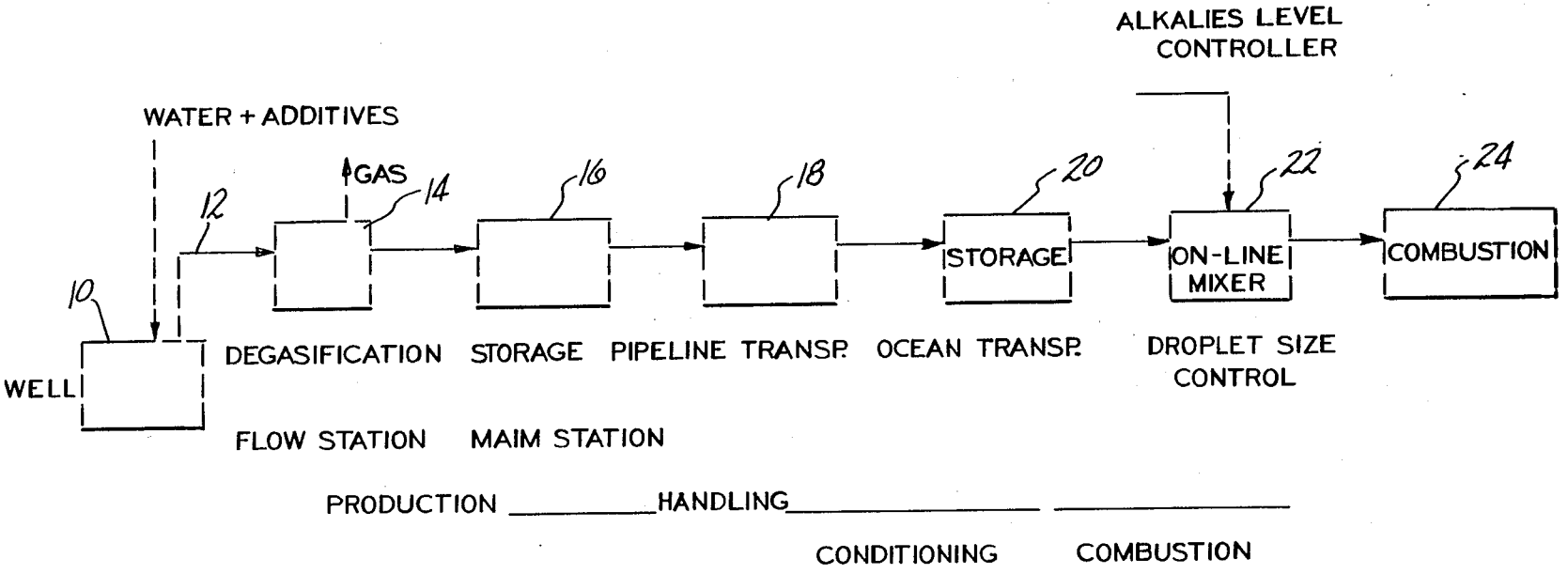
FIG. 1 is a diagram illustrating the flow scheme of the process of the present invention.

The process of the present invention will be described with reference to FIG. 1.

A deep well 10 having a downhole deep well pump is fed with water and an emulsifying additive so as to form an oil in water emulsion which can be pumped from the well 10 by the deep well pump and delivered via line 12 to a degasification station 14. The degassed oil in water emulsion may then be stored in storage area 16 for subsequent transportation by means 18 such as tanker, truck, pipeline or the like. Once transported, the oil in water emulsion can be stored in storage area 20 and/or delivered to a conditioning zone 22 where it is conditioned prior to burning in combustion area 24.

In accordance with the present invention, the process of the present invention is drawn to the preparation and burning of a natural fuel removed from a deep well. The fuel for which the process is suitable is a bitumen crude oil having a high sulfur content such as those crudes typically found in the Orinoco Belt of Venezuela. The bitumen crude oil has the following chemical and physical properties: C wt. % of 78.2 to 85.5, H wt. % of 10.0 to 10.8, O wt. % of 0.26 to 1.1, N wt. % of 0.50 to 0.66, S wt. % of 3.68 to 4.02, Ash wt. % of 0.05 to 0.33, Vanadium, ppm of 420 to 520, Nickel, ppm of 90 to 120, Iron, ppm of 10 to 60, Sodium, ppm of 60 to 200, Gravity, °API of 1.0 to 12.0, Viscosity (CST), 122° F. of 1,400 to 5,100,000, Viscosity (CST), 210° F. of 70 to 16,000, LHV (KCAL/KG) of 8500 to 10,000, and Asphaltenes wt. % of 9.0 to 15.0. In accordance with the present invention, a mixture comprising water and an emulsifying additive is injected into the well so as to form an oil in water emulsion which is pumped by means of a downhole deep well pump from the well. It is a critical feature of the present invention that the characteristics of the oil in water emulsion be such as to optimize transportation and combustion of the oil in water emulsion. The oil in water emulsion from the well should be characterized by a water content of about between 15 to 35 wt. %, preferably about between 20 to 30 wt. %; a droplet size of about between 10 to 60 μm, preferably about between 40 to 60 μm, and an alkali metal content of about between 50 to 600 ppm. It has been found that the level of alkali metals in the oil in water emulsion has a great effect on the amount of gaseous emissions upon combustion of the emulsion.

During the process for producing the bitumen crude oil by injecting water, a formation water is coproduced therewith. An analysis of the formation water found in the Orinoco Belt is set forth in Table 1.

TABLE I

| ANALYSIS OF FORMATION WATER | |
|---|---|
| Cl | 23640 |
| $CO_3$ | 2.1 |
| $HCO_3-$ | 284 |
| $NO_3-$ | 10 |
| $SO_4=$ | — |
| $Na^+$ | 14400 |
| $Ca^{++}$ | 427 |
| $Mg^{++}$ | 244 |
| $K^+$ | 462 |
| $Nlt_4+$ | 32 |
| $SiO_2$ | 64 |
| pH | 8.0 |

As can be seen from Table 1, the formation water contains significant amounts of alkali metals ($Na^+$, $Ca^{++}$, $Mg^{++}$and $K^+$). By controlling the amount and alkali metal content of the water injected with the emulsifying agent insures that the oil in water emulsion produced has the required alkali metal and water content as set forth above. As noted above, the water injected also contains an emulsifier additive. The emulsifier is added so as to obtain an amount of about between 0.1 to 5.0 wt. %, preferably from about between 0.1 to 1.0 wt. %, based on the total weight of the oil in water emulsion produced. In accordance with the present invention the emulsifier additive is selected from the group consisting of anionic surfactants, non-ionic surfactants, cationic surfactants, mixtures of anionic and non-ionic surfactants and mixtures of cationic and non-ionic surfactants. The non-ionic surfactants suitable for use in the process are selected from the group consisting of ethoxylated alkyl phenols, ethoxylated alcohols, ethoxylated sorbitan esters and mixtures thereof. Suitable cationic surfactants are selected from the group consisting of the hydrochlorides of fatty diamines, imidazolines, ethoxylated amines, amido-amines, quaternary ammonium compounds and mixtures thereof while suitable anionic surfactants are selected from the group consisting of long chain carboxylic, sulphonic acids and mixtures thereof. A preferred surfactant is a non-ionic surfactant with a hidrophilic-lipophilic balance of greater than 13 such as nonylphenol oxialhylated with 20 ethilene oxide units. Preferred anionic surfactants are selected from the group consisting of alkylaryl sulfonate, alkylaryl sulfate and mixtures thereof.

The water additive mixture injected into the well stabilizes the oil in water emulsion. The water injected will depend on the formation water being coproduced with the bitumen. Its salt content, will also depend on the bitumen water ratio required for appropriate handling and burning and finally will depend on the type and amount of emulsifier. It is at this stage that the fuel is formulated for to give the desired characteristics for handling and burning. Once the emulsion is formed and pumped out of the well, it can be degasified without much problem due to its low viscosity. This is not the case when bitumen alone has to be degasified which requires heating prior to separation of the gas.

The emulsion then can be storaged and pumped through the flow station and main stations and additives like imidazolines can be added to avoid any corrosion to the metal walls because of the presence of water. In any of the stages an in-line blender may be installed (after degasification, before pumping through a pipeline, before loading a tanker, etc.) to ensure a good emulsion with the adequate droplet size distribution as required above.

Figure 2:
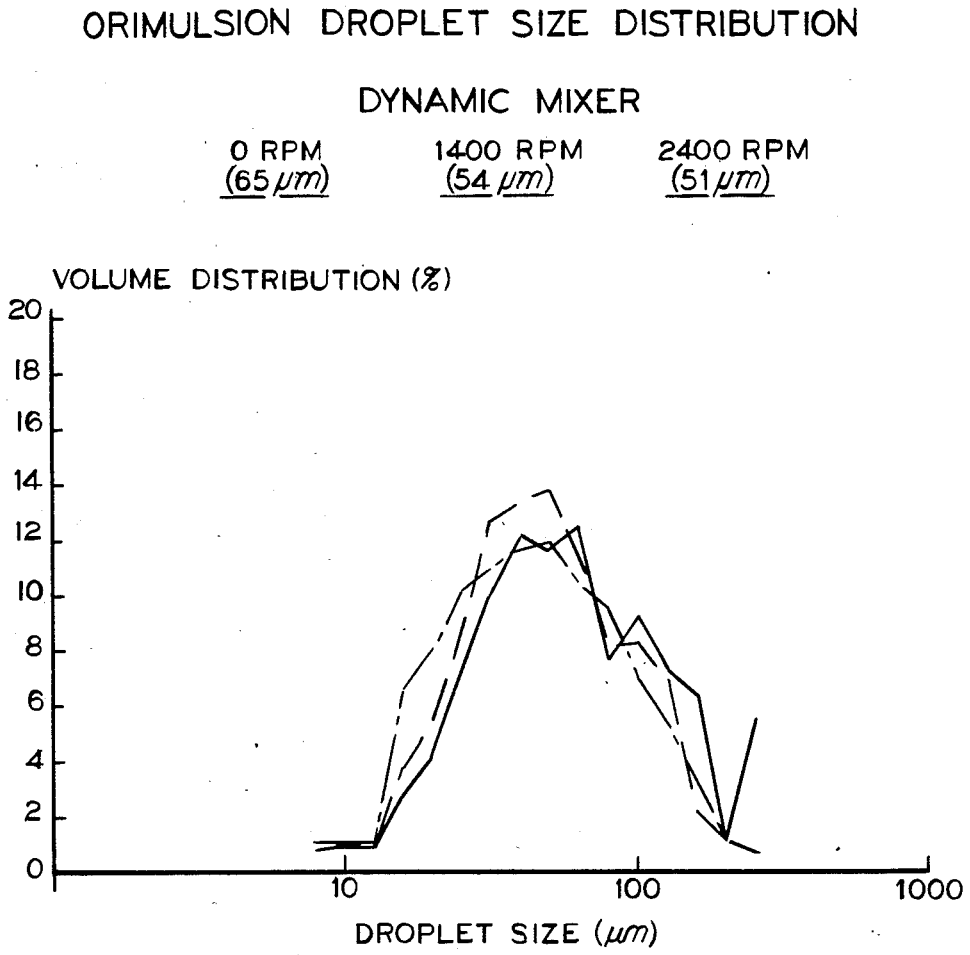
FIG. 2 is a graph showing typical droplet size of an oil in water emulsion.

Once the oil in water emulsion is transported to the combustion facility the emulsified fuel is conditioned so as to optimize the water content, droplet size and alkali metal content of the oil in water emulsion. The conditioning consists of an on-line mixer and an alkali metal level controller. The purpose of the on-line mixer is to control mean droplet size of the emulsified liquid fuel. Droplet size distribution has a very important effect on combustion characteristics of this natural fuel particularly in flow controllability and burn-out. Size distribution of the droplets are shown in FIG. 2 immediately before and after the on-line mixer. It can be seen that mean droplet size is reduced from 65 down to 51 μm. It is also seen that droplet size distribution is smoothed, that is, becoming a bell shaped-curve. In accordance with the present invention the oil in water emulsion should be characterized by a droplet size of from about between 10 to 60 μm.

It has also been found that the content of alkali metals in the oil in water emulsion has a great effect on its combustion characteristics, particularly on sulfur oxide emissions. Alkalies such as sodium, potassium, calcium and magnesium have a positive effect in reducing sulfur dioxide emission. It is believed that, due to high interfacial bitumen water surface to volume ratio, alkalies react with sulfur compounds present in the natural fuel to produce alkali sulfides such as sodium sulfide, potassium sulfide and calcium sulfide. During combustion, these sulfides are oxidized to sulfates thus fixing sulfate to the combustion ashes and thus preventing sulfur from going into the atmosphere as part of the flue gases. As noted above, alkalies are already added to the emulsion during the producing step of the natural fuel emulsion by means of a natural mix of alkalies contained in the production water. If alkali levels in the emulsion fuel are not found to be optimal then some additional amount can be added to the emulsion in the alkali level controller. This is done by adding production water, saline water or synthetic aqueous solutions of alkalies. In accordance with the present invention the oil in water emulsion should be characterized by an alkali metal content of about between 50 to 600 ppm, preferably 50 to 300 ppm.

Once the oil in water emulsion is conditioned it is ready for burning. Any conventional oil gun burner can be employed such as an internal mixing burner or twin hyperbolic atomizers. Atomization using steam or air under the following operating conditions is preferred: fuel temperature (°C.) of 20 to 80, preferably 20 to 60, steam/fuel ratio (wt/wt) of 0.05 to 0.5, preferably 0.05 to 0.4, air/fuel ratio (wt/wt) of 0.05 to 0.4, preferably 0.5 to 0.3, and steam pressure (Bar) of 1.5 to 6, preferably 2 to 4, or air pressure (Bar) of 2 to 7, preferably 2 to 4. Under these conditions excellent atomization and efficient combustion was obtained coupled with good flame stability.

Advantages of the present invention will be made clear from a consideration of the following examples.

EXAMPLE 1

In order to demonstrate the effects of alkali metal levels on the combustion characteristics of oil in water emulsions as compared to Orinoco bitumen, two emulsions were prepared having the characteristics set forth below in Table II (Orinoco bitumen is also set forth).

TABLE II

| FUEL CHARACTERISTICS | ORINOCO | EMULSION #1 | EMULSION #2 |
|---|---|---|---|
| ALKALINE LEVEL (PPM IN FUEL) | 0 | 10 | 160 |
| LHV (BTU/Lb) | 17455 | 13676 | 13693 |
| % OF BITUMEN | 100 | 77 | 77 |
| % OF WATER | 0 | 23 | 23 |

All the fuels were burned under the operating conditions set forth in Table III.

TABLE III

| OPERATING CONDITIONS | ORINOCO | EMULSION #1 | EMULSION #2 |
|---|---|---|---|
| FEED RATE (Kg/h) | 19.5 | 23.5 | 23 |
| TOTAL HEAT INPUT (BTU/H) | 750000 | 750000 | 750000 |
| FUEL TEMPERATURE (°C.) | 115 | 24 | 60–70 |
| STEAM/FUEL RATIO (W/W) | 0.4 | 0.2 | 0.43 |
| STEAM PRESSURE BAR | 4 | 4 | 2.8 |
| MEAN DROPLET SIZE (μm) | — | 60 | 51 |

The gaseous emissions and combustion efficiency for each of the fuels is set forth below in Table IV.

TABLE IV

| COMBUSTION CHARACTERISTICS | ORINOCO | EMULSION #1 | EMULSION #2 |
|---|---|---|---|
| $CO_2$ | 13.5 | 14 | 13 |
| CO | 0 | 0 | 0 |
| $O_2$ | 3 | 3.5 | 3 |
| $SO_2$ | 1500 | 1450 | 850 |
| $So_3$ | 12 | 8 | 6 |
| Nox | 690 | 430 | 417 |
| PARTICULATE (mg/Nm3) | 20 | 13 | 11 |
| EFFICIENCY | 99.0 | 99.9 | 99.9 |
| LENGTH OF RUN (HR) | 100 | 36 | 100 |

The results indicate that an increase in combustion efficiency is obtained for emulsified Orinoco over Orinoco virgin bitumen, that is, 99.9% compared to 99.0%. In addition, a comparison of Emulsion #1 and Emulsion #2 indicates that sulfur oxide emissions, $SO_2$ and $SO_3$ decrease with an increase in alkali metal levels.

EXAMPLE II

The effects of operating conditions on the combustion characteristics of varous fuels were studied. Table V compares Orinoco crude with seven oil in water emulsions.

TABLE V

| FUEL CHARACTERISTICS | ORINOCO | EMULSION #3 | EMULSION #4 | EMULSION #5 | EMULSION #6 | EMULSION #7 | EMULSION #8 | EMULSION #9 | EMULSION #10 |
|---|---|---|---|---|---|---|---|---|---|
| ALKALINE LEVEL (PPM IN FUEL) | 0 | 180 | 180 | 180 | 180 | 180 | 180 | 180 | 70 |
| LHV (BTU/Lb) | 17455 | 12900 | 12900 | 12900 | 13600 | 13600 | 13600 | 13600 | 13712 |
| % OF BITUMEN | 100 | 70 | 70 | 70 | 76 | 76 | 76 | 76 | 78 |
| % OF WATER | 0 | 30 | 30 | 30 | 24 | 24 | 24 | 24 | 22 |

The Orinoco bitumen and emulsions #3, #6, #7 and #10 were atomized with steam. Emulsions #4, #5, #8 and #9 were atomized with air. The operating conditions are set forth in Table VI.

TABLE VI

| OPERATING CONDITIONS | ORINOCO | EMULSION #3 | EMULSION #4 | EMULSION #5 | EMULSION #6 | EMULSION #7 | EMULSION #8 | EMULSION #9 | EMULSION #10 |
|---|---|---|---|---|---|---|---|---|---|
| FEED RATE (Kg/h) | 20.8 | 28.9 | 28.9 | 28.9 | 27.4 | 27.4 | 27.4 | 27.4 | 28.1 |
| TOTAL HEAT INPUT (BTU/H) | 820.000 | 820.000 | 820.000 | 820.000 | 820.000 | 820.000 | 820.000 | 820.000 | 820.000 |
| FUEL TEMPERATURE (°C.) | 115 | 60–70 | 60–70 | 60–70 | 60–70 | 60–70 | 60–70 | 60–70 | 60–80 |
| STEAM/FUEL RATIO (W/W) | 0.4 | 0.34 | — | — | 0.4 | 0.45 | — | — | 0.2 |
| AIR/FUEL RATIO (W/W) | — | — | 0.20 | 0.27 | — | — | 0.27 | 0.34 | — |
| STEAM/AIR PRESSURE (BAR) | 4 | 1.6 | 3 | 3 | 3.8 | 3.2 | 2.8 | 2.8 | 2.8 |
| MEAN DROPLET SIZE (μm) | — | 43 | 43 | 43 | 60 | 60 | 60 | 60 | 18 |

The combustion efficiency and gaseous emissions are set forth below in Table VII.

TABLE VII

| | COMBUSTION CHARACTERISTICS | | | | | | | | |
|---|---|---|---|---|---|---|---|---|---|
| | ORINOCO | EMUL-SION #3 | EMUL-SION #4 | EMUL-SION #5 | EMUL-SION #6 | EMUL-SION #7 | EMUL-SION #8 | EMUL-SION #9 | EMULSION #10 |
| $CO_2$ % MOLAR | 15.5 | 12.9 | 12.6 | 12.8 | 13.9 | 13.5 | 13.9 | 13.5 | 13.0 |
| CO ppm v | 1000 | 20 | 50 | 60 | 25 | 22 | 25 | 30 | 20 |
| $O_2$ % MOLAR | 3 | 3 | 3 | 3.2 | 2.7 | 3.3 | 2.8 | 3.2 | 2.8 |
| $SO_2$ ppm v | 1617 | 475 | 420 | 508 | 740 | 550 | 682 | 692 | 1350 |
| $SO_3$ ppm v | 10 | 5 | 5 | 5 | 6 | 6 | 9 | 9 | 10 |
| NOx ppm v | 717 | 434 | 478 | 645 | 434 | 600 | 451 | 454 | 690 |
| PARTICULATE (mg/Nm3) | 25 | 12.6 | 5.7 | 4 | 4 | 4 | 4 | 4 | 4 |
| EFFICIENCY | 98.7 | 99.9 | 99.9 | 99.9 | 99.9 | 99.9 | 99.9 | 99.9 | 99.9 |
| LENGTH OF RUN (HR) | 428 | 100 | 100 | 100 | 40 | 40 | 40 | 40 | 40 |

The results indicate substantial reductions in sulfur oxides when burning emulsions containing alkali metals as well as an increase in efficiency. In addition, the lower the air/fuel ratio the greater the reduction in sulfur oxides. The same would appear to hold true for lower steam/fuel ratios. Finally, the amount of nitrogen oxides was reduced. As compared to Orinoco crudes, the operating conditions in general are less severe when firing emulsified fuels; fuel atomizing, temperatures and pressures were lower, and the use of either air or stream added operational flexibility. Sulfur oxides emission reduction is an important feature of alkaline bearing oil in water emulsions. Sulfur trioxide emissions are responsible for the so-called cold-end corrosion that is sulfuric acid condensation in cooler parts of boilers (air heaters and economizers). It is also responsible for ash acidity in electrostatic precipitators and other solid capture equipment.

EXAMPLE 3

Figure 3:
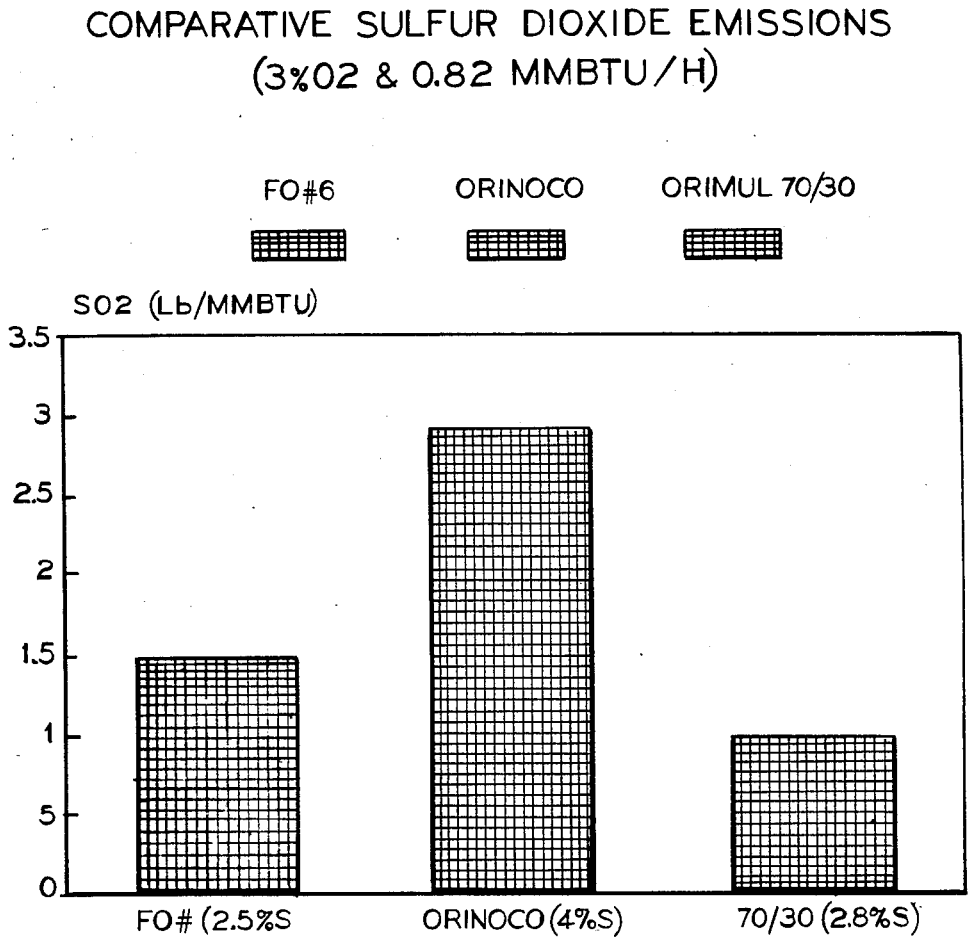
FIG. 3 is a graph showing comparative sulfur dioxide emissions between the oil in water emulsion of the present invention and No. 6 fuel oil.
Figure 4:
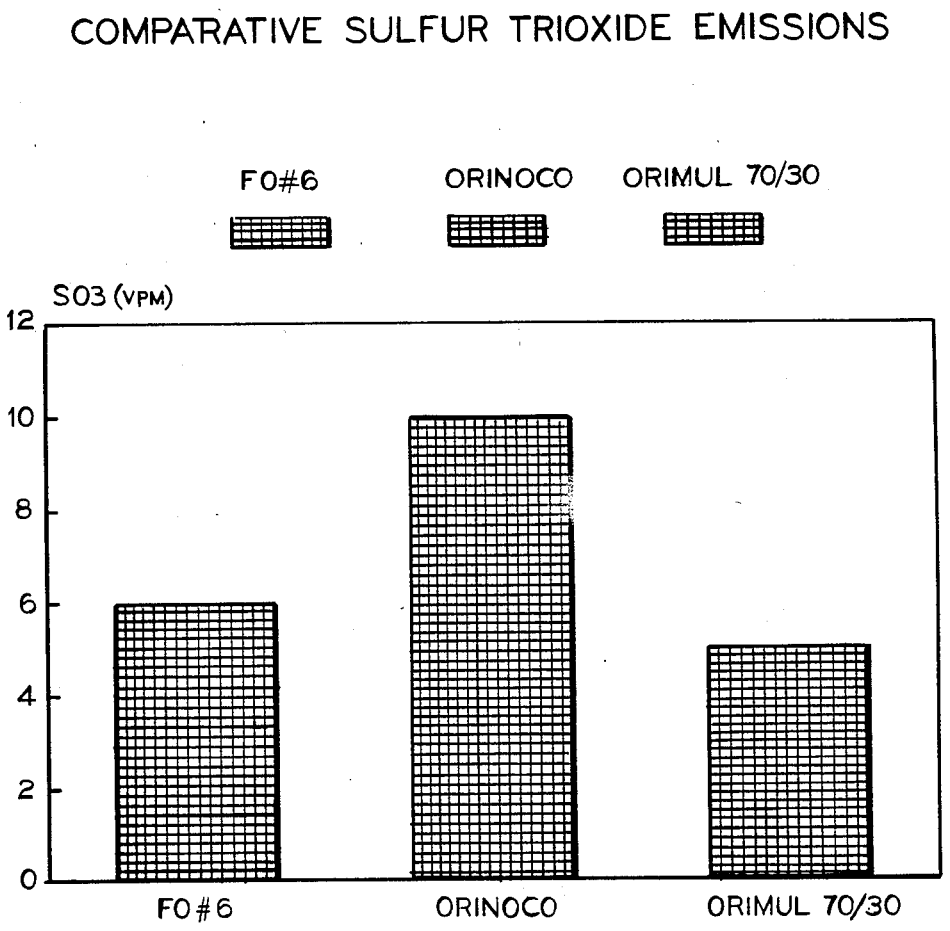
FIG. 4 is a graph showing comparative sulfur trioxide emissions between the oil in water emulsion of the present invention and No. 6 fuel oil.

The sulfur emissions of oil emulsion #3 of Example II were compared with No. 6 fuel oil and the results are set forth in FIGS. 3 and 4. The results indicate that the sulfur oxide emissions of the oil in water emulsion are favorable as compared to No. 6 fuel oil and far superior to Orinoco bitumen. $SO_2$ emission reduction is 33% as compared to fuel oil No. 6 and 66% as compared to Orinoco bitumen. Sulfur trioxide emissions are also lower for emulsion #3 as compared to fuel oil No. 6 (2.5% S) and Orinoco bitumen. These reductions account for 17% and 50% respectively.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A process for the preparation and burning of a natural liquid fuel from bitumen crude oil having a high sulfur content without further refining comprising the steps of:

(a) providing a downhole deep well pump for pumping said bitumen crude oil from a well, said bitumen crude oil has the following chemical and physical properties:

C wt. % of 78.2 to 85.5;
H wt. % of 10.0 to 10.8;
O wt. % of 0.26 to 1.1;
N wt. % of 0.50 to 0.66;
S wt. % of 3.68 to 4.02;
Ash wt. % of 0.05 to 0.33;
Vanadium, ppm of 420 to 520;
Nickel, ppm of 90 to 120;
Iron, ppm of 10 to 60;
Sodium, ppm of 60 to 200;
Gravity, °API of 1.0 to 12.0;
Viscosity (CST) 122° F. of 1,400 to 5,100,000; 210° F. of 70 to 16,000;
LHV (KCAL/KG) of 8,500 to 10,000; and
Asphaltenes wt. % of 9.0 to 15.0;

(b) injecting a mixture of water plus an emulsifier additive into said well wherein said emulsifier additive is present in an amount of about between 0.1 to 5% by weight based on the total weight of the oil in water emulsion so as to form an oil in water emulsion having a water content of about between 15 to 35 wt. % and an oil droplet size of about between 10 to 60 μm;

(c) pumpin said oil in water emulsion from said well to a flow station;

(d) degassing said oil in water emulsion;

(e) transporting said oil in water emulsion from said flow station to a combustion station without further refining;

(f) conditioning said oil in water emulsion so as to optimize the water content and droplet size and adding an alkali metal so as to obtain an oil in water emulsion wherein said oil in water emulsion has 20–40% wt. of water, 40–60 μm of mean droplet size and at least 50 ppm of alkaline content selected from the group consisting of $Na^+$, $Ca^{++}$, $Mg^{++}$and $K^+$and mixtures thereof in order to reduce the amount of sulfur emissions produced during subsequent burning as a natural liquid fuel;

(g) heating said optimized oil in water emulsion natural liquid fuel to a temperature of 20° to 80° C. and atomizing said fuel with a diluent selected from the group consisting of steam and air wherein said steam is at a pressure of 2 to 6 Bar in a steam to fuel ratio of 0.05 to 0.5 and said air is at a pressure of 2 to 7 Bar in an air to fuel ratio of 0.05 to 0.4; and (h) burning said atomized fuel whereby said sulfur dioxide and sulfur trioxide emissions are less than that of No. 6 fuel oil.

2. A process according to claim 1 wherein said fuel temperature is 20° to 60° C., said steam pressure is 2 to 4 Bar, said steam to fuel ratio is 0.05 to 0.4, said air pressure is 2 to 4 Bar and said air to fuel ratio is 0.05 to 0.3.

3. A process according to claim 1 wherein said emulsifier additive is selected from the group consisting of anionic surfactants, non-ionic surfactants, cationic surfactants and mixtures of cationic and non-ionic surfactants.

4. A process according to claim 3 wherein said non-ionic surfactants are selected from the group consisting of ethoxylated alkyl phenols, ethoxylated alcohols, ethoxylated sorbitan esters and mixtures thereof.

5. A process according to claim 3 wherein said cationic surfactants are selected from the group consisting of the hydrochlorides of fatty diamines, imidazolines, ethoxylated amines, amido-amines, quaternary ammonium compounds and mixtures thereof.

6. A process according to claim 3 wherein said anionic surfactants are selected from the group consisting of long chain carboxylic, sulfonic acids and mixtures thereof.

7. A process according to claim 1 wherein said emulsifier additive is a non-ionic surfactant with a hidrophillic-lipophilic balance of greater than 13.

8. A process according to claim 7 wherein said non-ionic surfactant is nonylphenol oxylated with 20 ethylene oxide units.

9. A process according to claim 6 wherein said anionic surfactant is selected from the group consisting of alkylaryl sulfonate, alkylaryl sulfate and mixtures thereof.

10. A process according to claim 1 including adding an anti-corrosion additive to said oil in water emulsion prior to transporting same.

* * * * *

UNITED STATES PATENT AND TRADEMARK OFFICE

CERTIFICATE OF CORRECTION

PATENT NO. : 4,801,304

DATED : January 31, 1989

INVENTOR(S) : DOMINGO R. POLANCO ET AL.

It is certified that error appears in the above-identified patent and that said Letters Patent is hereby corrected as shown below:

In Column 8, claim 1, line 35, change "pumpin" to read --pumping--.

In Column 8, claim 1, line 45, change "20-40%" to read --20-30%--.

Signed and Sealed this

Fifth Day of September, 1989

*Attest:*

*Attesting Officer*

DONALD J. QUIGG

*Commissioner of Patents and Trademarks*